US009022491B2

(12) United States Patent
Lundberg et al.

(10) Patent No.: US 9,022,491 B2
(45) Date of Patent: May 5, 2015

(54) TABLE TOP DISHWASHER

(75) Inventors: Mats Lundberg, Vaellingby (SE); Luigi Salerno, Cinisello Balsamo (IT)

(73) Assignee: Electrolux Home Products Corporation N.V., Brussels (BE)

( * ) Notice: Subject to any disclaimer, the term of this patent is extended or adjusted under 35 U.S.C. 154(b) by 145 days.

(21) Appl. No.: 13/996,633

(22) PCT Filed: Dec. 20, 2011

(86) PCT No.: PCT/EP2011/073472

§ 371 (c)(1),
(2), (4) Date: Apr. 9, 2014

(87) PCT Pub. No.: WO2012/084998

PCT Pub. Date: Jun. 28, 2012

(65) Prior Publication Data

US 2015/0035419 A1 Feb. 5, 2015

(30) Foreign Application Priority Data

Dec. 21, 2010 (EP) ..... 10015853

(51) Int. Cl.
*A47L 19/02* (2006.01)
*A47L 15/42* (2006.01)
(Continued)

(52) U.S. Cl.
CPC ..... *A47L 15/4263* (2013.01); *A47L 15/0089* (2013.01); *A47B 81/00* (2013.01); *A47B 2220/03* (2013.01)

(58) Field of Classification Search
CPC ..... A47B 2220/03; A47L 15/0089; A47L 15/0081; A47L 15/0076; A47L 15/42; A47L 15/4251; A47L 15/4263
USPC ..... 312/228, 296
See application file for complete search history.

(56) References Cited

U.S. PATENT DOCUMENTS 1,853,528 A 4/1932 Zademach
2,645,235 A 7/1953 Wheeler
(Continued)

FOREIGN PATENT DOCUMENTS

EP 2184000 A1 5/2010
WO WO 2006/006818 A1 1/2006

OTHER PUBLICATIONS

International Searching Authority, International Search Report for International Application No. PCT/EP2011/073472, mailed Feb. 14, 2012, 4 pages, European Patent Office, The Netherlands.
(Continued)

*Primary Examiner* — Daniel Rohrhoff
(74) *Attorney, Agent, or Firm* — Alston & Bird LLP

(57) ABSTRACT

A table top dishwasher comprises (a) a tub (10) for accommodating articles to be cleaned; (b) a water-tight hood (12) arranged over said tub (10), said hood comprising a fixed hood portion (14), an access opening (42), and a rotatable door (16) which is connected to the fixed hood portion so as to be rotatable between a raised opened position in which it exposes the access opening to provide access to the tub and a lowered closed position in which it closes the access opening and forms part of the water-tight hood; and (c) a gasket (44) which is attached to the fixed hood portion (14) or to the rotatable door (16) along an edge region of the access opening, wherein the fixed hood portion (14)or the rotatable door (16), respectively, comprises a plurality of mounting projections (46), and wherein the gasket comprises a plurality of apertures (54) in which the mounting projections are held by snap-fit connection.

12 Claims, 6 Drawing Sheets

(51) Int. Cl.
*A47L 15/00* (2006.01)
*A47B 81/00* (2006.01)

(56) References Cited

U.S. PATENT DOCUMENTS

| | | | | | |
|---|---|---|---|---|---|
| 2,850,025 | A | * | 9/1958 | Bond | 134/177 |
| 3,072,452 | A | * | 1/1963 | Sleeper | 312/228 |
| 4,368,747 | A | * | 1/1983 | Taylor | 134/93 |
| 5,518,014 | A | * | 5/1996 | McEachen | 134/107 |
| 2003/0041523 | A1 | | 3/2003 | Kiesler et al. | |
| 2011/0095029 | A1 | * | 4/2011 | Froelicher | 220/345.6 |
| 2011/0303253 | A1 | * | 12/2011 | Bari et al. | 134/58 D |
| 2012/0125369 | A1 | * | 5/2012 | Pers et al. | 134/18 |
| 2013/0334940 | A1 | * | 12/2013 | Lundberg et al. | 312/228 |
| 2014/0159555 | A1 | * | 6/2014 | Lundberg et al. | 312/228 |
| 2014/0285075 | A1 | * | 9/2014 | Lundberg et al. | 312/228 |

OTHER PUBLICATIONS

International Preliminary Report on Patentability and Written Opinion for Application No. PCT/EP2011/073472 dated Jun. 25, 2013.

* cited by examiner

TABLE TOP DISHWASHER

CROSS REFERENCE TO RELATED APPLICATIONS

This application is a national stage application, filed under 35 U.S.C. §371, of International Application No. PCT/EP2011/073472, filed Dec. 20, 2011, which claims priority to European Patent Application No. 1001 5853.4, filed Dec. 21, 2010, both of which are hereby incorporated by reference in their entirety.

The present invention relates to a table top dishwasher which comprises a tub for accommodating articles to be cleaned and a water-tight hood arranged over said tub, wherein the hood comprises a fixed hood portion, an access opening, and a rotatable door which is connected to the fixed hood portion so as to be rotatable between a raised opened position in which it exposes the access opening to provide access to the tub and a lowered closed position in which it closes the access opening and forms part of the water-tight hood.

The term "table top dishwasher" as used herein refers to a dishwasher which in contrast to common floor-mounted appliances is designed as a smaller unit which may be placed for example on a kitchen worktop or which is designed as a portable device. Such dishwashers are particularly suited for smaller households, in which only small amounts of articles are to be cleaned, or for use in mobile vehicles such as motor homes, camper vans, yachts and the like.

Dishwashers of any type usually comprise gaskets which provide for a water-tight sealing along the edges of the door, wherein often extruded gaskets are employed which have a continuous profile and which comprise a mounting section, which during assembly of the dishwasher is inserted into a groove provided close to the edge to be sealed. In an alternative approach, gaskets were attached to the housing or the door of the dishwasher by means of separate fixation elements, such as screws, clamps, bolts and the like, or by gluing the gasket to the respective component.

The above methods for fixing the gasket all have certain disadvantages. Thus, whereas mounting the gasket within a continuous groove minimizes the number of parts to be assembled, inserting the gasket into the groove is cumbersome and consumes a considerable amount of time. Attaching the gasket with fixation elements results in that the assembly becomes more complex and costly, since the separate fixation elements have to be provided and held on storage to be available for assembly with the dishwasher, wherein further the mounting of such fixation elements is time-consuming and requires specific tools. Gluing the gasket to the respective component is complicated and requires specifically designed adhesives which tolerate the operating conditions within a dishwasher, such as contact with water and humidity and exposure to a wide temperature range.

In view of the disadvantages of the prior solutions, it is an object of the present invention to provide for a table top dishwasher of the type indicated above in which mounting of the gaskets is facilitated.

In a table top dishwasher which comprises a tub for accommodating articles to be cleaned and a water-tight hood arranged over said tub, wherein the hood comprises a fixed hood portion, an access opening, and a rotatable door which is connected to the fixed hood portion so as to be rotatable between a raised opened position in which it exposes the access opening to provide access to the tub and a lowered closed position in which it closes the access opening and forms part of the water-tight hood, the above object is solved in that in accordance with the present invention the dishwasher further comprises a gasket which is attached to the fixed hood portion or to the rotatable door along an edge region of the access opening, wherein the fixed hood portion or the rotatable door, respectively, comprises a plurality of mounting projections, and wherein the gasket comprises a plurality of apertures in which the mounting projections are held by snap-fit connection.

Providing for a snap-fit connection between the apertures of the gasket and the mounting projections provided at the fixed hood portion or the rotatable door allows for a simple and quick assembly of the dishwasher wherein neither additional fixation elements nor specific tools are required. Rather, for mounting the gasket, the apertures are aligned with and pressed onto the mounting projections until the final mounting position is reached where the gasket is held at the mounting projections by snap-fit connection.

Preferred embodiments of the present invention are defined in the dependent claims.

The snap-fit connection can be provided for by selecting the open area of the apertures of the gasket such that it is slightly smaller than the cross section of the mounting projections. While the gasket is formed of a resilient material, such as a rubber or plastic material, the gasket thus is held at the mounting projections by the force created when the material of the gasket along the apertures is stretched by pushing the apertures over the slightly larger mounting projections.

In preferred embodiments the mounting projections comprise a base section the cross section of which substantially corresponds to the shape of the apertures within the gasket and the length of which corresponds to the depth of such apertures, wherein the mounting projections further comprise an end section having a retainer which extends beyond the cross section of the base section and overlaps the gasket, i.e. laterally projects from the mounting projections. The retainer can comprise one or more latching protrusions which laterally project from the mounting projections, such as one or more individual latch members, a continuous or discontinuous rim or a tapering which projects outwardly from the mounting projections.

While in such embodiments, the gasket is held at the mounting projections by the differences in cross-sectional shape of the apertures versus that of the mounting projections in the region where the retainer is provided, the apertures either can be designed to exactly or loosely fit about the mounting projections, or the apertures can have an open area which again is slightly smaller than the cross section of the mounting projections, so that the gasket additionally is held by the tension created within the gasket material about the mounting projections.

In preferred embodiments the gasket comprises a sealing section and a mounting section, wherein the edge region where a sealing action shall be provided is accommodated between the sealing section and the mounting section, so that the mounting section faces away from the sealing section. By providing the gasket with a sealing section and a mounting section, wherein the mounting section faces away from the sealing section, i.e. has a different orientation than the sealing section, wherein the edge region where a sealing action shall be provided is accommodated between the sealing section and the mounting section, the mounting section of the gasket can be provided spatially separate from the sealing section, so that these sections do not interfere with each other. Hence the gasket can be attached solely by handling the mounting section without at the same time having to manipulate also the sealing section. Furthermore, with the mounting section facing away from the sealing section, the mounting projections can be provided at a location where they do not interfere with the sealing surface.

In a particularly preferred embodiment the sealing section is located at the interior side of the water-tight hood, and the mounting section is located at the exterior side of the water-tight hood. Thus, the gasket can extend along a lateral edge of the access opening, wherein the mounting projections are provided at an exterior side of a side wall of the water-tight hood. Alternatively, the gasket can be provided at a bottom edge of the access opening, wherein the sealing section extends along an upper or inner side of a front wall of the water-tight hood and wherein the mounting projections are provided at an exterior side of the front wall.

By providing the mounting projections at an exterior side of the water-tight hood, the mounting projections can be located at a region of the dishwasher which is easily accessible during manufacturing, which thus further facilitates assembly of the dishwasher.

Particularly when the mounting projections are provided at an exterior side of the water-tight hood, the dishwasher further can comprise a cover member which covers the mounting section of the gasket, so that the mounting projections are not visible to a user of the dishwasher.

Preferred embodiments of the present invention will be described below by reference to the drawings, in which.

Figure 1:
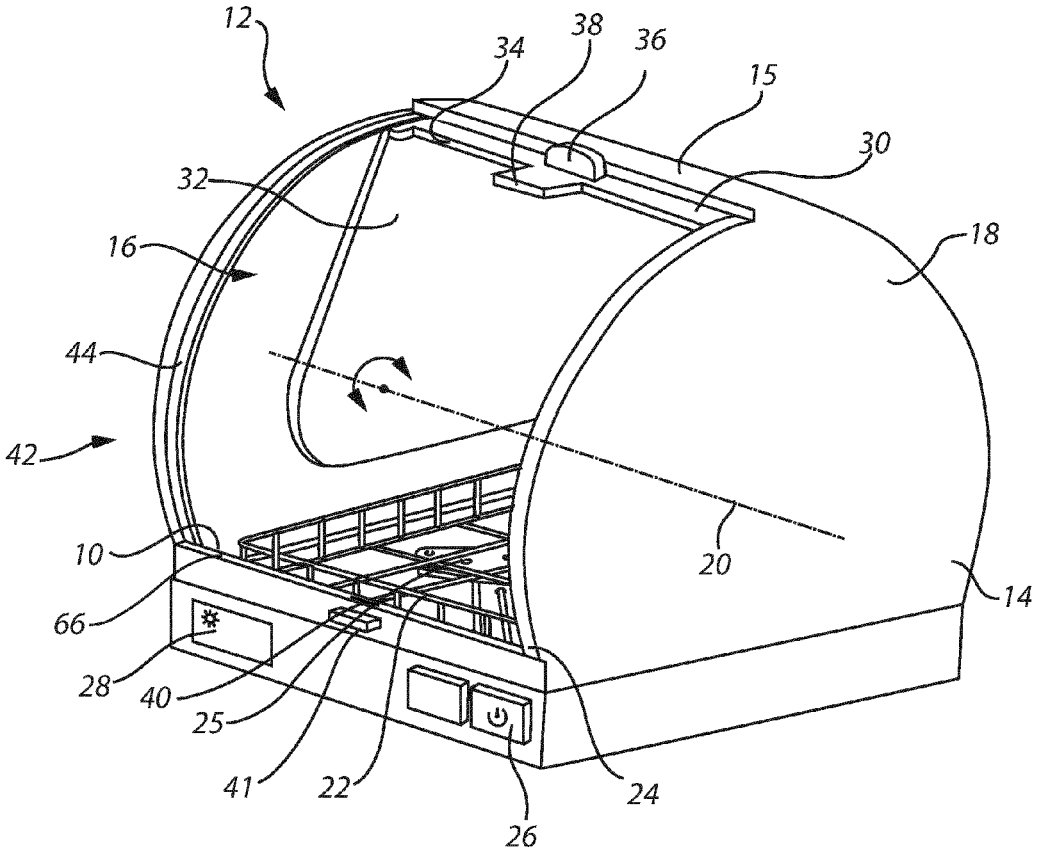
FIG. 1 is a perspective view of a table top dishwasher of the present invention.

FIG. 1 shows a table top dishwasher comprising a tub 10 and a cover member 12, which forms a hood over tub 10. Cover member or hood 12 is a generally cylindrical member comprising a fixed hood portion 14 and a rotatable door 16. Door 16 is rotatably supported at substantially semi-circular side portions 18 of the fixed hood portion so as to be pivotable about a horizontal axis 20. Within tub 10 there is provided a basket 22 which comprises a plurality of holders 24 for accommodating and fixing during a washing cycle a plurality of articles to be cleaned.

Within tub 10 there further are provided means for circulating cleaning liquid throughout the interior of the dishwasher, such as a spray arm 25 which is located below basket 22, and a circulation pump (not shown) and optionally a separate drain pump. In the lower portion of the dishwasher comprising tub 10 there further can be located any electrical components which are employed for operation of the dishwasher, such as a power supply, a controller and the like, as well as operating switches 26 and a display 28.

As shown in FIG. 1, cover member 12 is a generally cylindrical or semi-cylindrical part, wherein approximately half of the arcuate surface shell is provided by the central region 15 of fixed hood portion 14 and the other half thereof is provided by door 16 which comprises an arcuate central region 30 and two lateral side regions 32. At the lateral side regions 32 door 16 is hinged to the semi-circular side portions 18 of the fixed hood portion 14 so as to be rotatable about axis 20 between the fully opened position shown in FIG. 1 and a closed position which is reached by rotating door 16 in a counter-clockwise direction in FIG. 1 until the lower edge 34 of door 16 contacts a respective sealing surface provided at tub 10.

In the embodiment shown in FIG. 1 door 16 further comprises a handle 50 which facilitates closing of the door and which at the same time provides for a stop which delimits rotation of door 16 at the fully opened position shown in FIG. 1. At the bottom side of lower edge 34 of the door there is provided a catch member 38 which in the closed position of the door is received within a corresponding recess 40 provided at the front wall of tub 10, wherein a latch provided within recess 40 maintains the door in the closed position, which latch can be operated either manually by a release knob 41 or automatically by the central program unit of the dishwasher.

Figure 2:
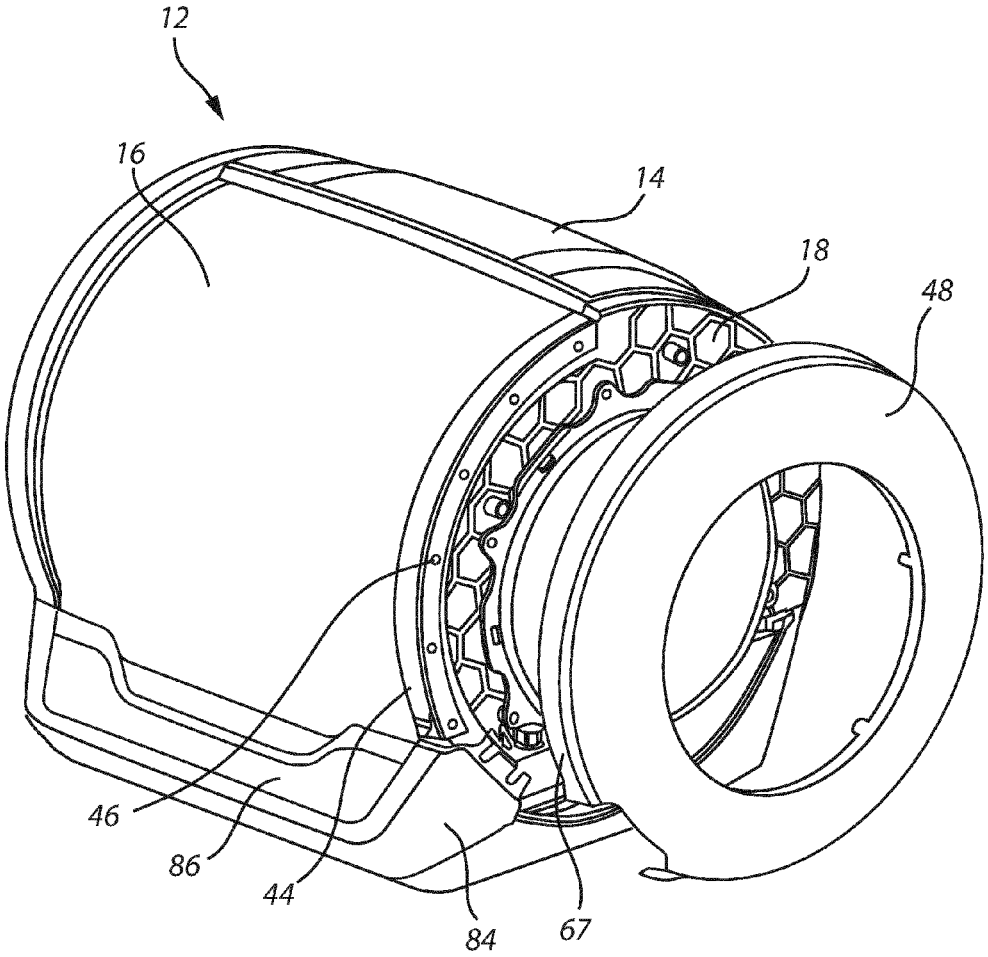
FIG. 2 is a perspective view of a modified embodiment of the dishwasher of FIG. 1 when a side cover has been removed.

FIG. 2 illustrates a modified embodiment of the dishwasher of FIG. 1, wherein the table top dishwasher of FIG. 2 likewise comprises a generally cylindrical hood 12, comprising a fixed hood portion 14 and a rotatable door 16, which in FIG. 2 is shown in the closed position in which the door closes the access opening 42 via which articles to be cleaned can be placed into basket 22 or can be removed therefrom.

As shown in FIG. 2, side seals 44 are provided along the front lateral edges of the side portions 18 of the fixed hood portion 14, wherein side seals 44 are attached to the fixed hood portion 14 at a plurality of mounting projections 46, as will be explained in further detail below. In FIG. 2 there further is shown a side cover 48 which when mounted to the side portion 18 of fixed hood portion 14 covers mounting projections 46.

Figure 3:
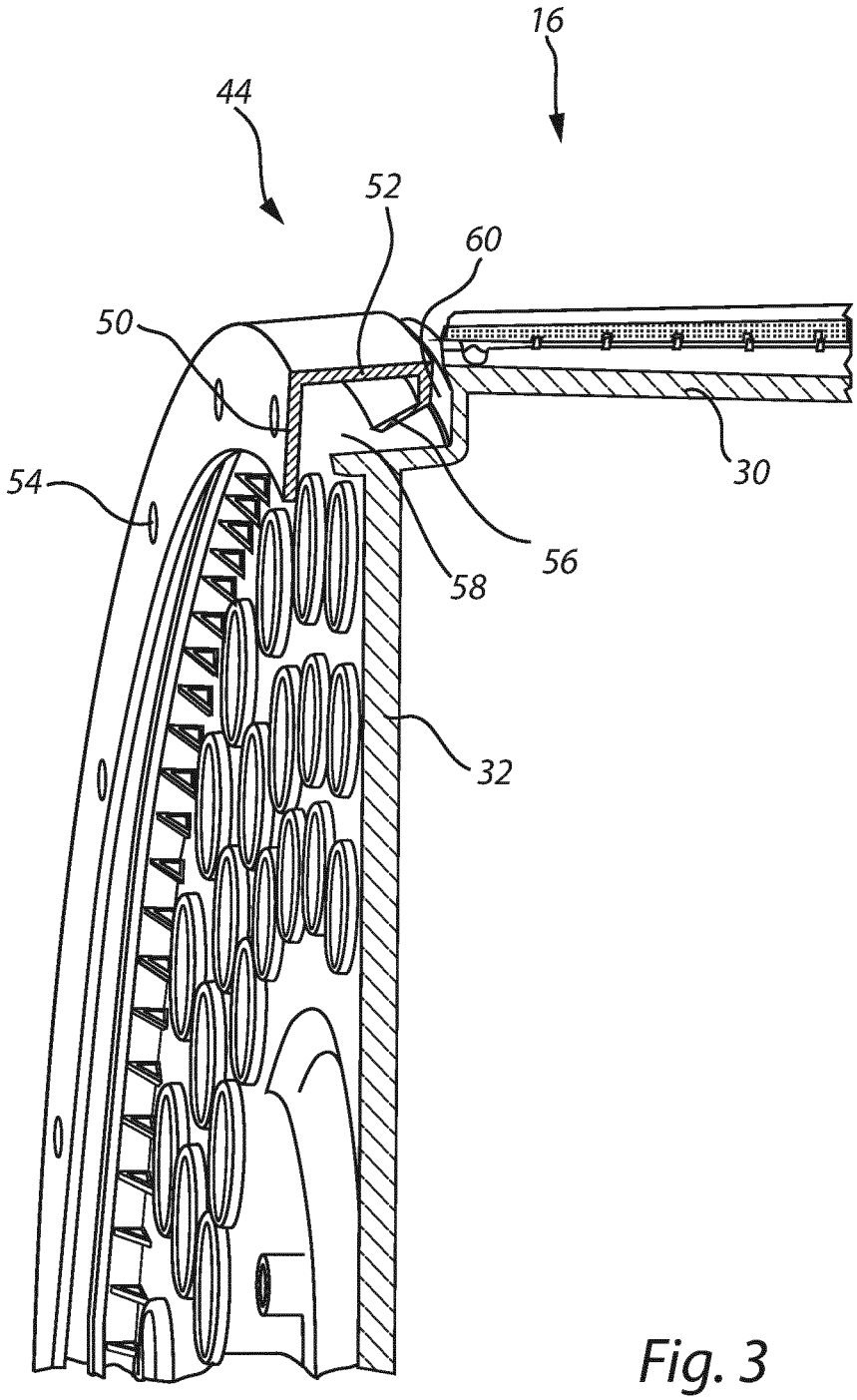
FIG. 3 is a perspective view of only the door and the side seal when the door is closed.

FIG. 3 is a perspective view of only the rotatable door 16 and the side seal 44 when the door is closed, wherein the side portion 18 of the fixed hood portion 14 to which the side seal 44 is attached has been omitted for illustrative purposes.

As can be seen in FIG. 3, side seals 44 have a substantially rectangular cross-section and comprise a first leg 50 which extends in parallel to the side regions 18 of the fixed hood portion 14 and a second leg 52 which projects in the axial direction of the cylindrical shape of the fixed hood portion 14. First leg 50 which serves as mounting section of side seal 44 comprises a plurality of apertures 54 which, when side seal 44 is mounted to the fixed hood portion 14, each engage one of the mounting projections 46. In order to fixedly attach side seal 44 at the fixed hood portion 14, the geometries of the mounting projections 46 and of the apertures 54 are selected such that the mounting projections 46 are held within apertures 54 by snap-fit connection.

A sealing lip 56 extends from the free end of the second leg 52 towards the axis of fixed hood portion 14 so as to contact from above an abutment surface 58 that is provided at the exterior side of rotatable door 16. When rotatable door 16 is closed, as shown in FIG. 2, side seal 44 over its full length engages abutment surface 58 of rotatable door 16, so as to prevent water or steam from exiting hood 12. The curvatures of the side seals and that of the abutment surfaces substantially correspond in their radius of curvature so that the side seals and the abutment surfaces therefore provide for a continuous and sound contact in a direction perpendicular to the axis of rotation of the door when the door is closed, so as to provide for a reliable sealing along the lateral edges of the door. However, in order to avoid that the side seals remain in contact with their abutment surfaces over the full range of travel of the rotating door, the center of curvature of the side seals preferably is offset with respect to the center of curvature of the abutment surfaces, so that when rotating the door from the closed position towards the opened position, the contact pressure on the seals is reduced or the contact between the side seals and abutment surfaces is even terminated. In this manner, excess wear of the side seals during continued operation of the table top dishwasher is avoided.

As can be seen in FIG. 1 but particularly in the detailed view of FIG. 3, abutment surface 58 is provided in a recess 60 which extends along the lateral edge of rotatable door 16. In case that during a washing cycle water enters the gap between side seal 44 and abutment surface 58 of the door 16, any such water will be guided to flow along recess 62 back into the tub 10.

Figure 4:
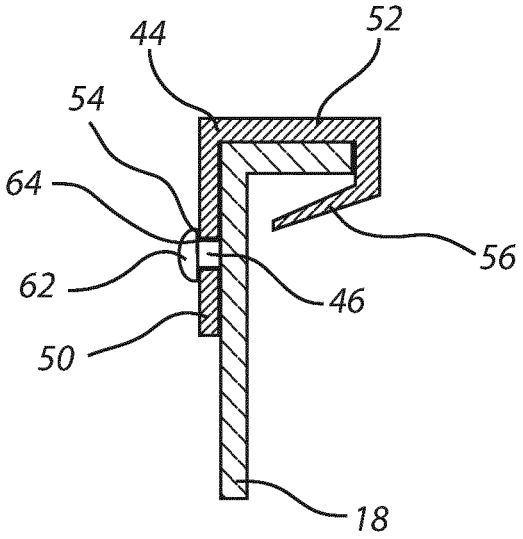
FIG. 4 is a sectional view of the side seal of FIG. 3.

FIG. 4 shows in sectional view side seal 44 when mounted to the side region 18 of fixed hood portion 14. In the embodiment illustrated in FIG. 4, aperture 54 has a slightly larger diameter than the portion of mounting projection 46 which extends through aperture 54. In order to provide for a snap-fit connection between side seal 44 when an side region 18, mounting projection 46 comprises an end section 62 having an outwardly projecting rim 64 the diameter of which is larger than that of aperture 54. Hence, when during assembly of the dishwasher first leg 50 of side seal 44 is pressed against the edge of side region 18 of the fixed hood portion 14, rim 64 temporarily stretches aperture 54, wherein the resilient material of side seal 44 contracts as soon as rim 64 has passed aperture 54. When employed in the embodiment of the dishwasher shown in FIG. 2, the second leg 52 of side seal 44 will be located below a circumferential rim 67 of side cover 48, which stabilizes the first leg 52 when abutment surface 58 of the door contacts the sealing lip 56 of side seal 44.

Figure 5:
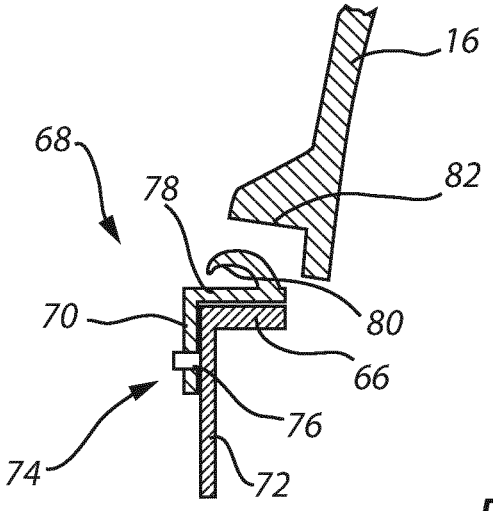
FIG. 5 is a sectional view of a front seal.

FIG. 5 illustrates an embodiment of a gasket made in accordance with the teachings of the present invention, wherein the gasket is designed as a front seal 68 which provides for a sealing between the bottom edge 66 of the access opening 42 and the lower edge of the rotatable door 16. In this embodiment, front seal 68 comprises a first leg 70 which constitutes a mounting section of front seal 68 which serves for fixation at the front side of a wall member 72 which forms the lower front part of the hood 12. First leg 70 of front seal 68 comprises a plurality of apertures 74 in which mounting projections 76 are received that are provided at the front side of a wall member 72. In this embodiment, a snap-fit connection between front seal 68 and hood 12 is provided in that the open area of the apertures 74 is slightly smaller than the cross section of the mounting projections 76, so that when the gasket is mounted the resilient gasket material is stretched about the apertures 74 and thus clamps on the mounting projections 76.

Front seal 68 comprises a second leg 78 which in the embodiment of FIG. 5 extends perpendicular to first leg 70 and which comprises a sealing lip 80 which projects upwardly from second leg 78. When the rotatable door 16 is closed, sealing lip 80 is engaged by an abutment surface 82 which is provided at the front side of rotatable door 16 in proximity to its lower edge. When employed in the dishwasher shown in FIG. 2, the first leg 70 of front seal 68 will be hidden behind a cover element 84, which further houses a control panel 86 for operation of the dishwasher.

Figure 6:
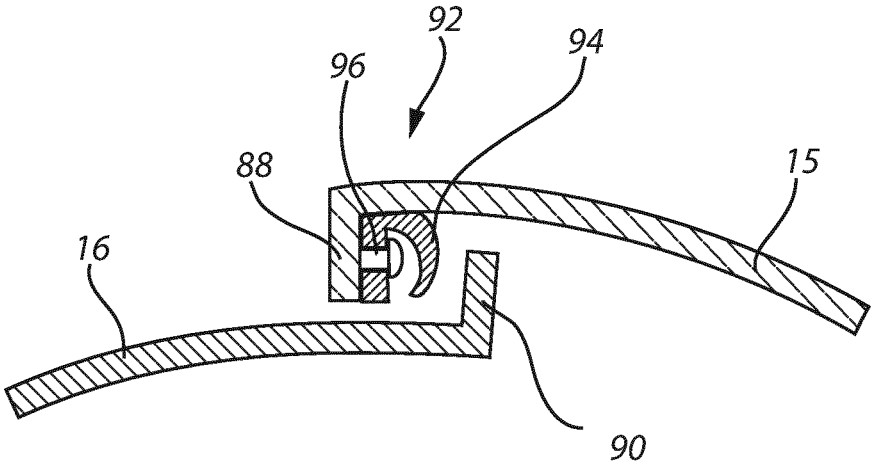
FIGS. 6 to 8 are sectional views of top seals
Figure 7:
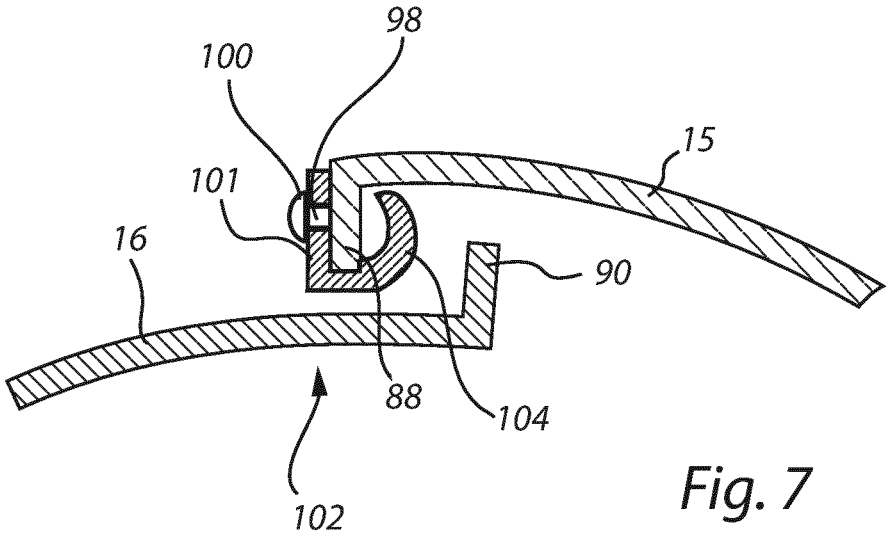

FIGS. 6 and 7 illustrates embodiments of a gasket which is designed as a top seal to prevent escape of water or steam at the rear edge of the rotatable door 16 when the door is in the closed position shown in FIG. 2. In embodiments of the dishwasher wherein as shown in FIGS. 1 to 3 the rotatable door 16 is arranged to be rotatable along the interior side of the hood 12, so that when the door 16 is in its opened position it is located below the fixed portion 14, in order to provide for a sealing along the upper edge of access opening 42, the central region 15 of fixed hood portion 14 comprises a first rim 88 which projects radially downwards towards the rotatable door 16. Similarly, the rotatable door 16 comprises a second rim 90 which projects radially upwards towards the central region 15 of fixed hood portion 14. A top seal 92 is provided at the side of first rim 88 which faces towards the second rim 90. When the door 16 is lowered into its closed position, first rim 88 and second rim 90 approach each other, wherein the front side of second rim 90 which faces top seal 92 finally engages a sealing lip 94 of top seal 92. As illustrated in FIG. 6, top seal 92 which has a generally U-shaped profile is attached at first rim 88 by means of a snap-fit connection at a plurality of mounting projections 96 that are provided at the inner face of first rim 88.

FIG. 7 illustrates a variant of the top seal arrangement shown in FIG. 6 which differs from the embodiment of FIG. 6 in that in the embodiment of FIG. 7 the snap-fit connection between the top seal and the central region 15 of fixed hood portion 14 is provided at the exterior side of the hood. To this end a plurality of mounting projections 98 is provided at the outer face of first rim 88, which mounting projections 98 engage corresponding apertures 100 provided in a first leg 101 of a generally U-shaped top seal 102, the second leg of which forms a sealing lip 104 which when the door 16 is lowered into its closed position engages the front side of second rim 90.

Figure 8:
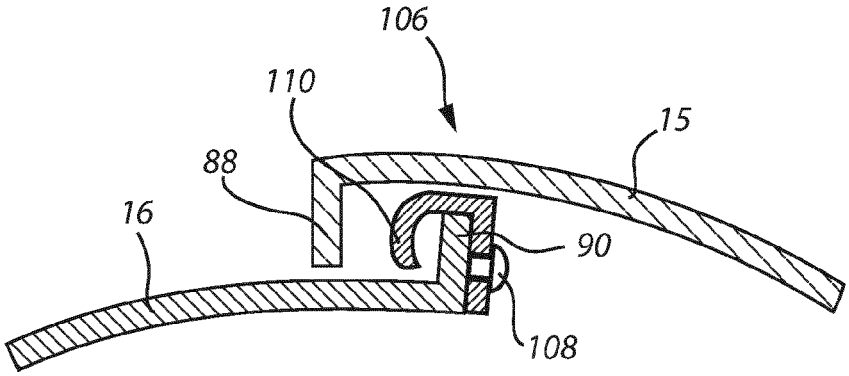

FIG. 8 illustrates a further variant of a top seal arrangement which differs from the embodiments shown in FIGS. 6 and 7 in that in the FIG. 8 embodiment a top seal 106 is attached to the second rim 90 of rotatable door 16 rather than to fixed hood portion 14. As shown in FIG. 8, a plurality of mounting projections 108 is provided at the rear side of second rim 90, which mounting projections 108 engage corresponding apertures provided in a first leg of generally U-shaped top seal 106, the second leg of which forms a sealing lip 110 which when the door 16 is lowered into its closed position engages the rear side of first rim 88.

REFERENCE SIGNS

10 tub
12 cover member
14 fixed hood portion
15 central region of 14
16 rotatable door
18 side portion
20 horizontal axis
22 basket
24 holder
25 spray arm
26 operating switch
28 display
30 central region of 16
32 side portion of 16
34 lower edge of 16
36 handle
38 catch member
40 recess
42 access opening
44 side seal
46 mounting projections
48 side cover
50 first leg
52 second leg
54 aperture
56 sealing lip
58 abutment surface
60 recess
62 end section
64 rim
66 bottom edge
67 circumferential rim

68 front seal
70 first leg
72 wall member
74 aperture
76 mounting projections
78 second leg
80 sealing lip
82 abutment surface
84 cover element
86 panel
88 first rim
90 second rim
92 top seal
94 sealing lip
96 mounting projection
98 mounting projection
100 aperture
101 first leg
102 top seal
104 sealing lip
106 top seal
108 mounting projection
110 sealing lip

The invention claimed is:

1. A table top dishwasher, comprising:

(a) a tub for accommodating articles to be cleaned;

(b) a water-tight hood arranged over said tub, said hood comprising a fixed hood portion, an access opening, and a rotatable door which is connected to the fixed hood portion so as to be rotatable between a raised opened position in which it exposes the access opening to provide access to the tub and a lowered closed position in which it closes the access opening and forms part of the water-tight hood; and (c) a gasket which is attached to the fixed hood portion or to the rotatable door along an edge region of the access opening, wherein the fixed hood portion or the rotatable door, respectively, comprises a plurality of mounting projections, and wherein the gasket comprises a plurality of apertures in which the mounting projections are held by snap-fit connection.

2. The dishwasher of claim 1, wherein the open area of the apertures is smaller than the cross section of the mounting projections.

3. The dishwasher of claim 1, wherein the mounting projections comprise a base section the cross section of which substantially corresponds to the shape of the apertures and the length of which corresponds to the depth of the apertures, and an end section comprising a retainer which extends beyond the cross section of the base section and overlaps the gasket.

4. The dishwasher of claim 3, wherein the retainer comprises one or more latching projections which laterally projects from the mounting projections.

5. The dishwasher of claim 4, wherein the end section comprises a rim projecting outwardly from the mounting projections.

6. The dishwasher of claim 3, wherein the end section comprises a tapering projecting outwardly from the mounting projections.

7. The dishwasher of claim 1, wherein the gasket comprises a sealing section and a mounting section, wherein said edge region is accommodated between the sealing section and the mounting section, so that the mounting section faces away from the sealing section.

8. The dishwasher of claim 7, wherein the sealing section is located at the interior side of the water-tight hood, and the mounting section is located at the exterior side of the water-tight hood.

9. The dishwasher of claim 8, wherein the gasket extends along a lateral edge of the access opening, wherein the mounting projections are provided at an exterior side of a side wall of the water-tight hood.

10. The dishwasher of claim 9, wherein the gasket comprises a mounting section extending parallel to said side wall, an intermediate section projecting inwardly over the edge of said side wall, and a sealing section projecting inwardly from said intermediate section.

11. The dishwasher of claim 8, further comprising a cover member which covers the mounting section of the gasket.

12. The dishwasher of claim 7, wherein the gasket extends along a bottom edge of the access opening, wherein the mounting projections are provided at an exterior side of a front wall of the water-tight hood, and wherein the sealing section extends along an upper or inner side of said front wall.

* * * * *